US006989094B2

(12) United States Patent
Knapp et al.

(10) Patent No.: US 6,989,094 B2
(45) Date of Patent: Jan. 24, 2006

(54) POOL SKIMMER SCREEN

(76) Inventors: Shepherd L. Knapp, P.O. Box 311, Jupiter, FL (US) 33468; Cynthia M. Knapp, P.O. Box 311, Jupiter, FL (US) 33468

( * ) Notice: Subject to any disclaimer, the term of this patent is extended or adjusted under 35 U.S.C. 154(b) by 0 days.

(21) Appl. No.: 10/799,633

(22) Filed: Mar. 15, 2004

(65) Prior Publication Data

US 2005/0199538 A1 Sep. 15, 2005

(51) Int. Cl.
*E04H 4/16* (2006.01)
*E04H 4/12* (2006.01)

(52) U.S. Cl. ..... 210/169; 210/232; 210/416.2; 4/496; 4/507

(58) Field of Classification Search ..... 210/169, 210/232, 416.1, 416.2; 4/490, 496, 507
See application file for complete search history.

(56) References Cited

U.S. PATENT DOCUMENTS

| | | | | |
|---|---|---|---|---|
| 4,140,634 A | | 2/1979 | Harry | |
| 4,369,109 A | | 1/1983 | Edge | |
| 4,426,286 A | | 1/1984 | Puckett et al. | |
| 4,960,514 A | * | 10/1990 | Paskert | 210/169 |
| 4,961,849 A | * | 10/1990 | Hull et al. | 210/169 |
| 5,100,541 A | | 3/1992 | Kallenbach | |
| 5,377,623 A | | 1/1995 | Parr | |
| 5,487,830 A | | 1/1996 | Huppert | |
| 5,510,020 A | | 4/1996 | Gronlund | |
| 5,862,541 A | | 1/1999 | Mailhot | |
| 5,935,450 A | | 8/1999 | Benedict | |
| 6,214,217 B1 | * | 4/2001 | Sliger, Jr. | 210/169 |
| 6,760,931 B1 | * | 7/2004 | Mattson et al. | 4/541.1 |
| 2003/0213059 A1 | | 11/2003 | Mattison Jr. | |

FOREIGN PATENT DOCUMENTS

WO WO 94/23158 10/1994

* cited by examiner

*Primary Examiner*—Fred G. Prince
(74) *Attorney, Agent, or Firm*—Richard C. Litman

(57) ABSTRACT

The pool skimmer screen is a device for preventing debris, bees, and other small insects and animals from being lodged in the pool skimmer. The skimmer screen, removably mounted to the swimming pool wall in front of the pool skimmer mouth, includes a substantially rigid support frame having a screen fitted taut therein. The skimmer screen includes a plurality of magnets mounted on the rear of the frame whereby the skimmer screen may be magnetically attached to the metallic surface of an above-ground swimming pool. The skimmer screen may be adapted for attachment to a swimming pool having plaster, tile or other non-metallic surface by the use of metallic pads mounted to the wall of the swimming pool and positioned to adhere to the magnets of the skimmer screen.

8 Claims, 4 Drawing Sheets

POOL SKIMMER SCREEN

BACKGROUND OF THE INVENTION

1. Field of the Invention

The present invention relates to pool filtration systems, and more particularly to devices for preventing the introduction of insects and debris into the filtration system 2. Description of the Related Art Swimming pool filtration systems normally include a water intake that directs the water through a pump to a filter unit before returning the filtered water to the pool. The water intake normally comprises a bottom drain incorporated with a skimmer, the skimmer being positioned in a swimming pool wall at the height of the water surface. Floating debris is directed to the skimmer, which normally has an accessible and removable basket recessed behind the wall of the swimming pool that can be emptied of accumulated leaves and other debris.

Skimmer adapters have been developed primarily due to the fact that the manufacturer-supplied basket is normally hidden from view, thereby hindering filtration when the basket fails to be emptied when full and possibly leading to pump and motor failure. Furthermore, it relatively small size requires frequent emptying in the presence of an abundance of leaves or debris. The disadvantage of the skimmer basket and large skimmer scoops is that in certain climates, bees, frogs and small aquatic creatures are more of a concern then leaves and debris. These unwanted pool guests invariably find their way into these skimmers and nets, only to be trapped and drowned, and must then be removed from the device. Except for a few exotic devices specifically designed for frogs, the devices disclosed herein provide no quarter to bees and other unfortunates trapped by the skimming device.

U.S. Pat. No. 4,140,634, issued to J. Harry in February 1979, discloses a skimmer shield comprising a rigid wire frame from which a baffle is supported and a receptacle for collecting waterlogged debris falling from the baffle. The '634 device is permanently mounted to the side of the swimming pool with bolts and cannot be readily removed therefrom.

U.S. Patent Publication No. 2003/0213059, published in November 2003, discloses a combination suction fixture and disposable filter for a whirlpool bath. The filter is fibrous having a porous core, wherein the porous core has a series of holes and/or slots graduating in size from small at the outlet end to large at the remote end. The suction fixture has a removable faceplate attached to the housing via a magnet, and a peripheral ledge provides a pop off design.

U.S. Pat. No. 4,369,109, issued to W. Edge in January 1983, discloses a skimming net that includes a frame attachable to a side portion of the pool and extending outwardly into the pool area. The net is slidably positioned over the frame, the frame being capable of being tilted at a plurality of different angles. A quick disconnect mechanism is provided whereby the frame and its net may be quickly removed from the pool.

Similarly U.S. Pat. No. 5,487,830, issued to D. Huppert in January 1996, discloses a generally rectangular swimming pool skimming device comprising tubular frame pipes having a screen positioned between the pipes. At least one of the pipes has a horizontally positioned hook extending perpendicularly therefrom and adapted to be affixed to the edge of the swimming pool. In a similar fashion, International Publication No. WO 94/23158, published in October 1994, discloses a frame with a sack like collection net having means for attaching to the edge of a swimming pool in order to collect leaves and other floating material.

U.S. Pat. No. 5,935,450, issued to C. Benedict in August 1999, discloses screens for protecting the intake openings of pool skimmer systems, which include a body portion having front and opposing sidewalls. Retention flanges extend from the body for retaining the screens within the intake openings.

Several skimming devices have been introduced which are sensitive to the plight of small animals that may be trapped by the pool's filtration system. U.S. Pat. No. 5,377,623, issued to J. Parr in January 1995, discloses a device for supporting a frog in a swimming pool to keep the frog from being trapped within the pool skimmer. The device includes a resting pad with a convex top surface that extends slightly below the water line so that a frog may climb on the pad. The device is supported and attached to a ladder of a swimming pool with a snap-on clamp. Another frog rescue device disclosed in U.S. Pat. No. 5,862,541, issued to L. Mailhot in June 1999, includes an exit ramp adapted to attach to a conventional pool skimmer screen bucket which enables small animals caught in the skimmer to climb up out of the basket and exit onto the pool deck. Although well intentioned, the '623 and '541 patents are designed primarily for frogs and other small climbing animals and only provide relief to animals that have already been trapped within the skimmer basket.

U.S. Pat. No. 4,426,286, issued to Puckett et al. in January 1984, U.S. Pat. No. 5,100,541, issued to D. Kallenbach in March 1992, and U.S. Pat. No. 5,510,020, issued in April 1996 to R. Gronlund, have been provided as further related devices in the field of pool skimmers.

None of the aforementioned inventions and patents, taken either singly or in combination, is seen to describe the instant invention as claimed. Thus a pool skimmer screen solving the aforementioned problems is desired.

SUMMARY OF THE INVENTION

The pool skimmer screen is a device particularly useful for preventing bees and other small insects and animals from being lodged in the skimmer of a swimming pool filtration system. The skimmer screen is magnetically attached to the wall of a swimming pool wall, the screen being positioned directly across the skimmer intake. The skimmer screen includes a substantially rigid support frame having a screen fitted taut therein and a plurality of magnets mounted on the rear of the frame.

Best suited for climates where insects are more of a concern then leaves, the pool skimmer screen of the present invention, unlike devices that have sack-like nets that can trap and easily drown bees, insects and other small animals, provides these animals with a chance for survival without detracting from the skimmer screen's primary function, which is to protect the pools filtration system from clogging and ensuing damage. Furthermore, the magnetically attached screen is easily removed and shaken to remove whatever debris or insects that find themselves unable to extricate themselves from the screen.

Although primarily designed for above-ground pools with a metallic surface in the area of the mouth of the skimmer, the skimmer screen can be adapted for use with any swimming pool, including swimming pools with non-metallic surfaces. Using metallic pads affixed to the wall of the swimming pool the magnetically attachable skimmer screen may be mounted to the wall of any swimming pool.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
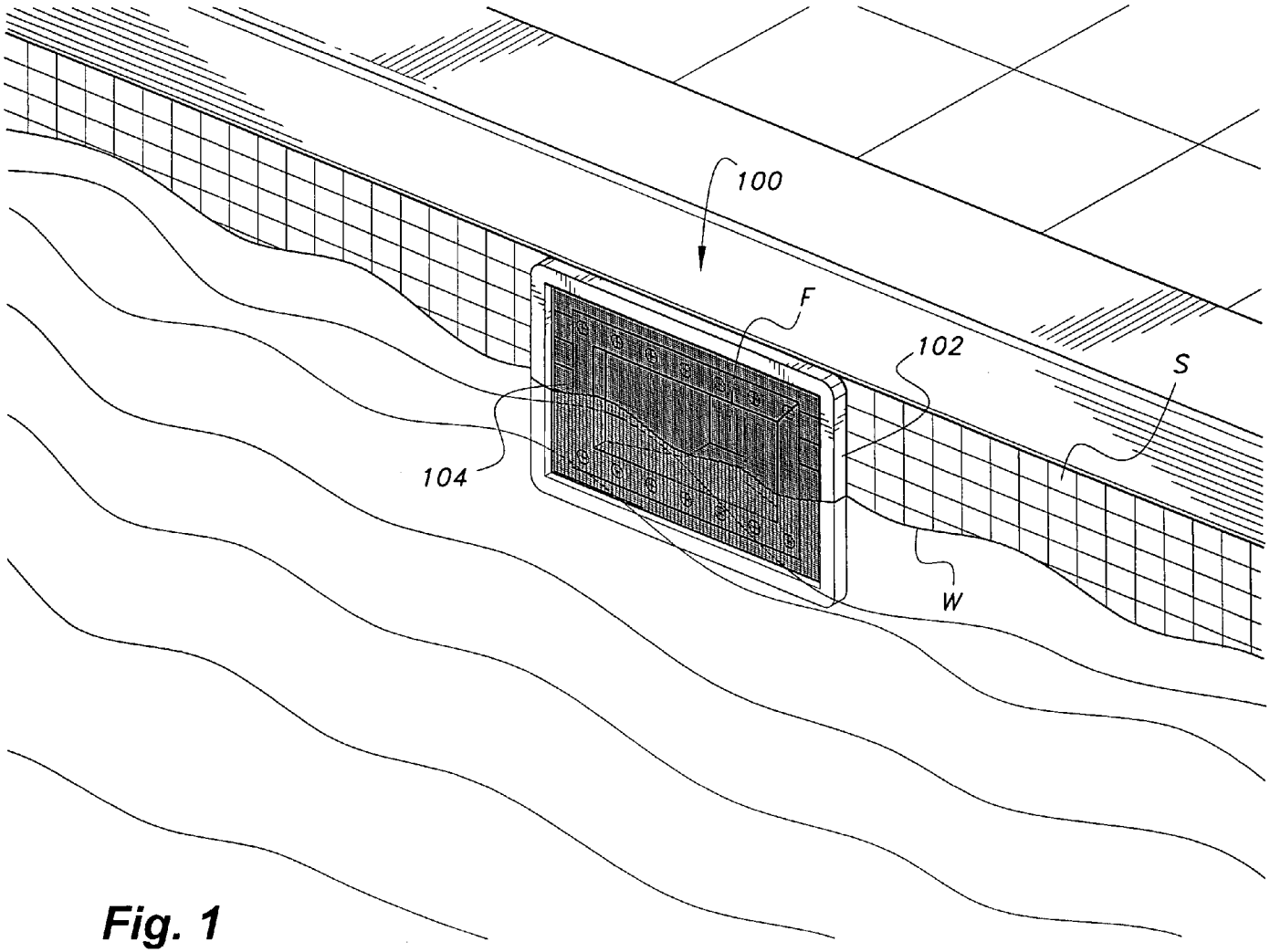
FIG. 1 is an environmental, perspective view of a pool skimmer screen according to the present invention.
Figure 2:
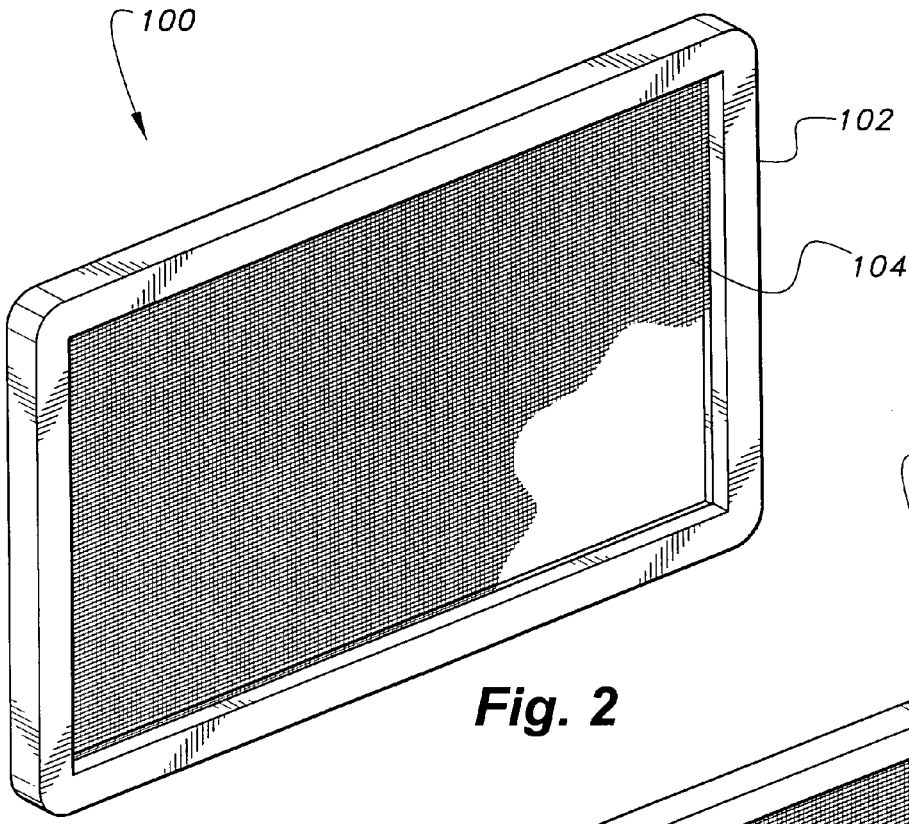
FIG. 2 is a perspective view of the pool skimmer screen according to the present invention as seen from the front.

The present invention is a swimming pool skimmer screen, designated generally as 100 in the drawings. The skimmer screen 100 is particularly useful for preventing, bees, and other small insects and animals from being trapped in the skimmer of a swimming pool filtration system. In normal operation, the pool is filled to where the waterline W is approximately halfway up the height of the mouth of the skimmer inlet F. The skimmer screen 100 is magnetically attached to the wall S of a swimming pool wall such that the screen 100 is positioned directly across the skimmer intake F.

Figure 3:
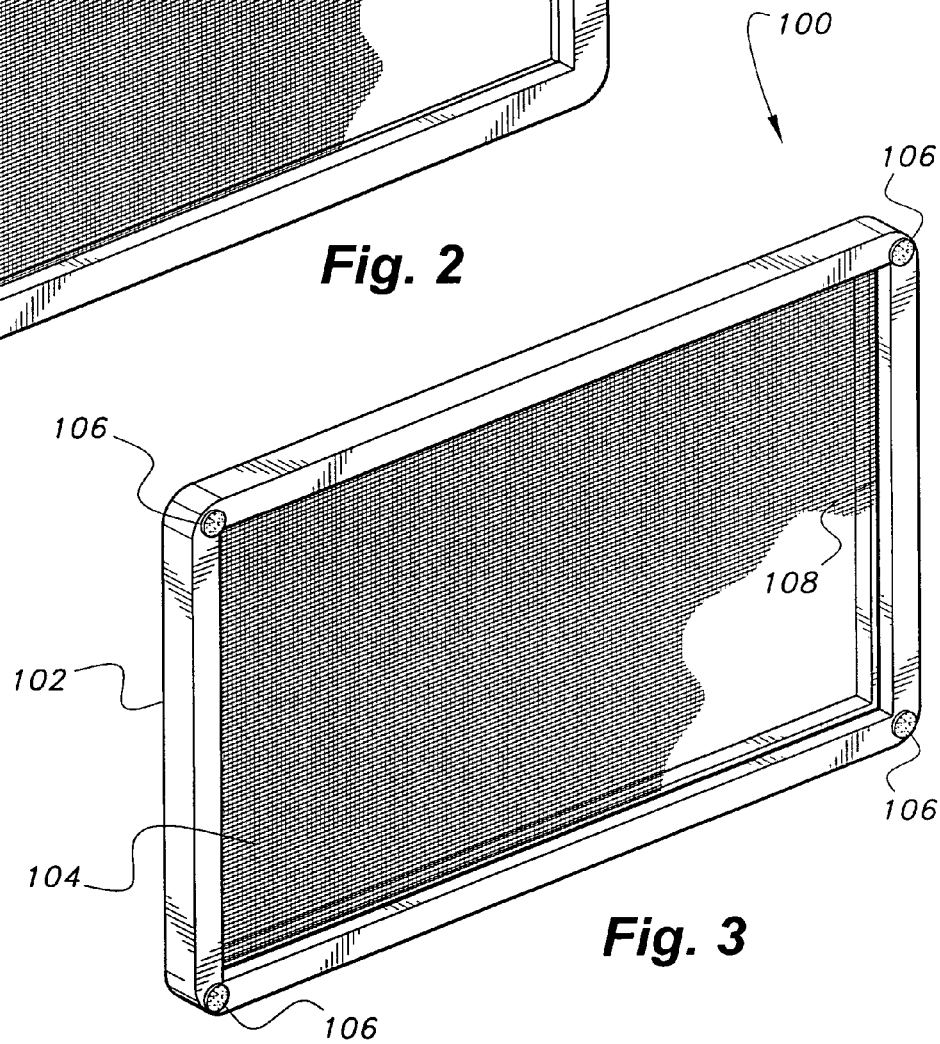
FIG. 3 is a rear perspective view of the pool skimmer screen according to the present invention showing the magnets mounted in the corners of the frame.
Figure 4:
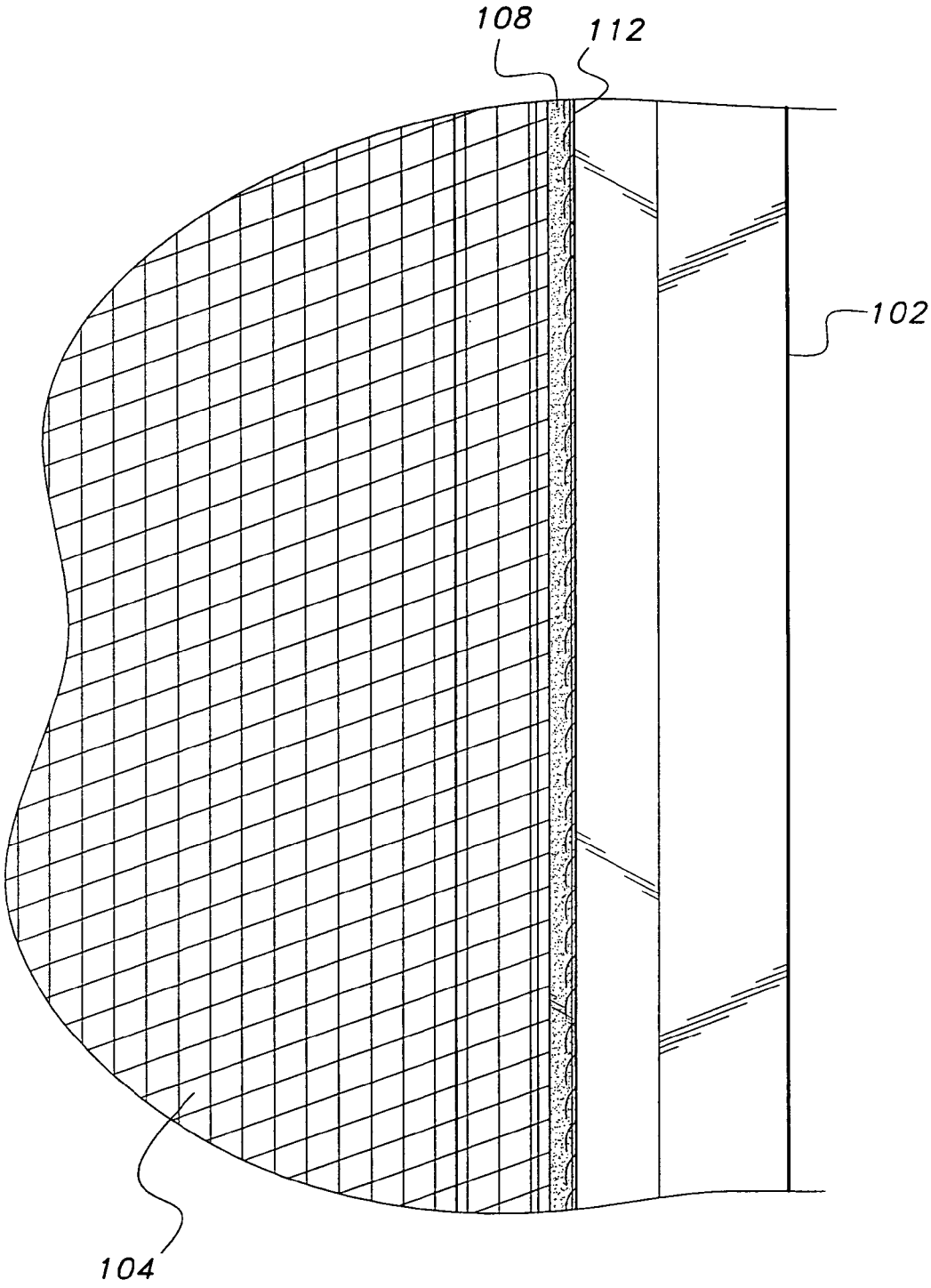
FIG. 4 is a fragmented detail view of the pool skimmer screen according to the present invention illustrating the manner of attaching the screen mesh to the frame.

As shown in FIGS. 1–4, the skimmer screen 100 includes a substantially rigid support frame 102 having a screen 104 fitted taut therein. The frame 102 in the preferred embodiment is rectangular and may be made of any substantially rigid material including plastic and aluminum, although the frame 102 may have any shape required or desired that extends across the skimmer intake opening F. The screen material 104 is any conventional mesh screening material as known in the art, but preferably made of a synthetic material unaffected by the pool water or the chemicals therein. As best shown in FIG. 4, the mesh screen material is secured in place by a rubber spine 108 received by a recess 112 defined within the inside perimeter of the frame 102.

Designed primarily for above ground pools with metallic walls, the skimmer screen 100 is attachable to the wall S by means of four thin magnets 106 as shown in FIG. 3. The magnets 106 are mounted at the corners of the frame 102 on the rear surface of the screen 100, or may be recessed and retained within the frame 102 in order to provide a smaller profile and to minimize the opening between the rear of the frame 102 and the surface S of the swimming pool. The magnets 106 may be affixed to, or mounted within, the frame 102 by an adhesive or by other appropriate mounting means, e.g., fasteners. Depending upon the level of activity in the pool, rare earth magnets, due to their stronger magnetic attraction and smaller footprint than standard ferromagnetic material, may be used to provide stronger adhesion and minimal spacing between the frame 102 and the wall S.

The frame 102 is preferably hollow and should have sufficient buoyancy to keep the skimmer screen 100 afloat should the skimmer screen 100 detach from the wall S. Alternatively, the frame 102 may be filled with closed cell foam or other material known in the art to provide positive buoyancy, thereby allowing the skimmer screen 100 to be easily retrieved from the surface of the water.

Figure 5:
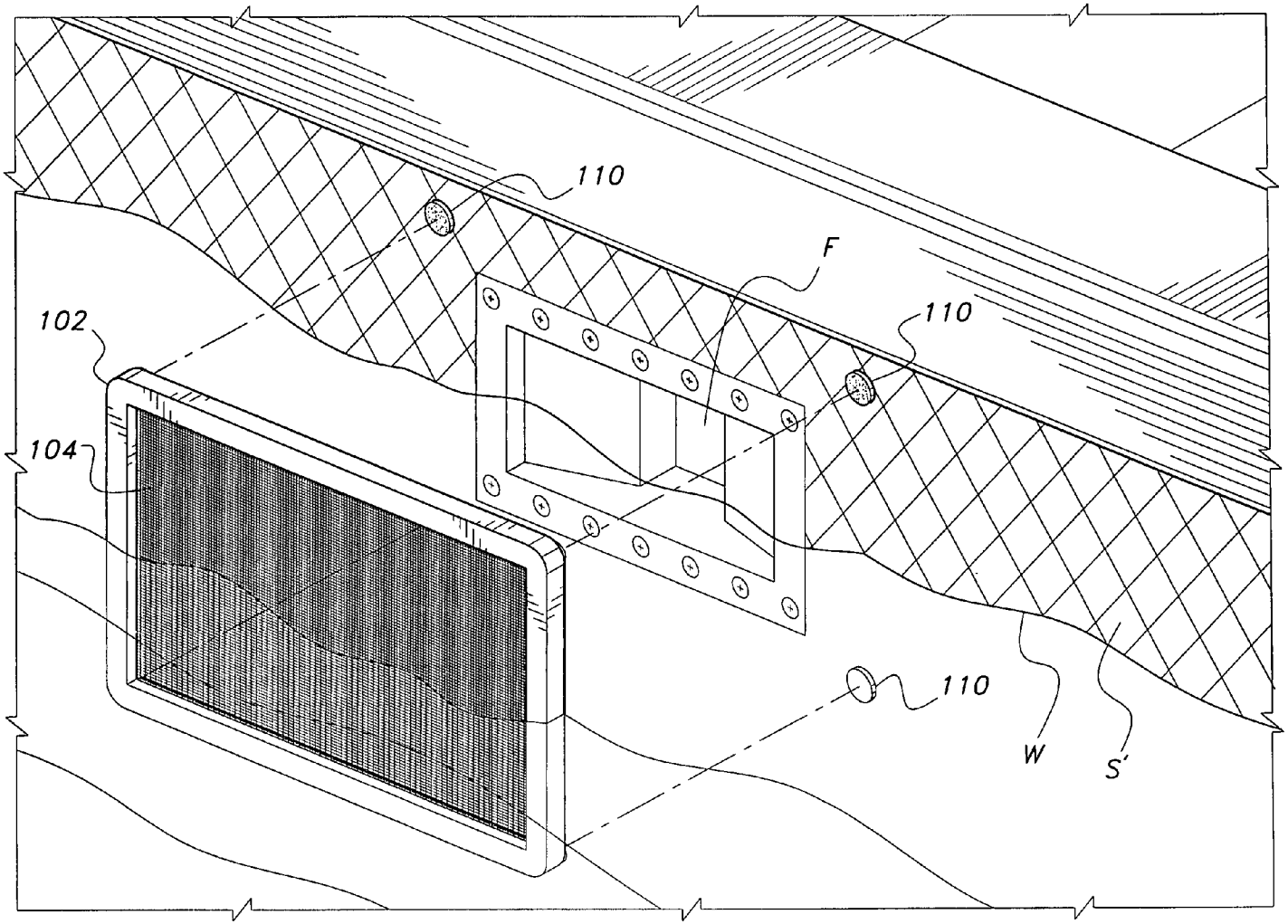
FIG. 5 is an exploded, environmental perspective view of a pool skimmer screen according to the present invention having metallic pads by which the screen is mountable to the wall of a non-metallic swimming pool.

The skimmer screen 100 can be installed in a swimming pool of any size or configuration. Although the skimmer screen 100 is designed to be magnetically attached to the metallic surface S of an above ground pool, FIG. 5 illustrates an alternate embodiment designed for swimming pools having tile, plaster or other non-metallic sides S' to which a set of metallic pads 110 may be mounted in order to provide a point of attachment for the magnets 106 mounted on the rear of the frame 102.

It is to be understood that the present invention is not limited to the embodiments described above, but encompasses any and all embodiments within the scope of the following claims.

We claim:

1. A pool skimmer screen for placement across a mouth of a swimming pool skimmer inlet, comprising:

a substantially rigid, hollow support frame having a front surface and a rear surface;

a mesh screen fitted within the support frame;

a plurality of magnets disposed on the rear surface of the support frame;

the support frame further comprising a buoyant material enclosed therein, such that the pool skimmer screen has positive buoyancy with respect to water contained within the swimming pool; and whereby the support frame affords quick and easy cleaning of the skimmer screen, and whereby bees and other insects are prevented from entering the swimming pool skimmer mouth.

2. The pool skimmer screen according to claim 1, further comprising a plurality of ferromagnetic metallic pads adapted for being mounted to a non-metallic surface surrounding a swimming pool skimmer mouth, the metallic pads being magnetically attachable to the magnets disposed on the support frame for attaching the pool skimmer screen to a swimming pool having non-metallic surfaces.

3. The pool skimmer screen according to claim 1, wherein the mesh screen is stretched tight across the support frame.

4. The pool skimmer screen according to claim 1, wherein the support frame is substantially rectangular.

5. The pool skimmer screen according to claim 4, wherein the magnets are adhesively mounted to the corners of the support frame.

6. The pool skimmer screen according to claim 5, wherein the magnets are rare earth magnets.

7. A pool skimmer screen for placement across a mouth of a swimming pool skimmer inlet, comprising:

a substantially rigid, rectangular and hollow support frame having a front surface and a rear surface;

a mesh screen stretched taut across the support frame;

a plurality of magnets disposed on the rear surface of the support frame; and buoyant material disposed within the support frame;

whereby the support frame affords quick and easy cleaning of the skimmer screen, and whereby bees and other insects are prevented from entering the swimming pool skimmer mouth.

8. The pool skimmer screen according to claim 7, further comprising a plurality of ferromagnetic metallic pads adapted for mounting to a non-metallic surface surrounding the swimming pool skimmer mouth, the metallic pads being magnetically attachable to the magnets disposed on the support frame, thereby attaching the pool skimmer screen to a swimming pool having non-metallic surfaces.

* * * * *